United States Patent [19]

Liaq

[11] Patent Number: 4,904,976

[45] Date of Patent: Feb. 27, 1990

[54] COMBINATION PLUG

[76] Inventor: Nan W. Liaq, No. 18, Tzu Yu Rd., Hsin Chu City, Taiwan

[21] Appl. No.: 326,670

[22] Filed: Mar. 21, 1989

[51] Int. Cl.[4] ..... H01H 85/02

[52] U.S. Cl. ..... 337/197; 337/198; 439/622

[58] Field of Search ..... 337/197, 198; 439/621, 439/622

[56] References Cited

U.S. PATENT DOCUMENTS 4,684,914 8/1987 Wu ..... 337/198

4,768,979 9/1988 Wu ..... 337/197

*Primary Examiner*—H. Broome

*Attorney, Agent, or Firm*—Morton J. Rosenberg; David I. Klein

[57] ABSTRACT

A combination plug including an outer housing, an inner housing slidably insertable into the outer housing, a fuse assembly retained within the inner housing, and a snap fitted conductor body fitted within the outer housing. The inner housing includes a pair of prongs which are passable through respective slots of the outer housing and a pair of openings for receiving the prongs of an add-on plug. The fuse assembly includes an H-shaped plastic fuse holder, a pair of fuses held in respective grooves of the plastic fuse holder, and four copper covers, each cover covering a respective terminal of the H-shaped fuse holder and connecting both ends of each fuse. The snap fitted conductor body includes a conductor tap casing, two conducting wires, and two conductor taps. The provision of the copper covers is to provide a larger contact surface between the fuses and the conducting taps of the conductor body and the prongs.

4 Claims, 3 Drawing Sheets

COMBINATION PLUG

BACKGROUND OF THE INVENTION

The present invention relates to fused electrical plugs, and more particularly, to a combination plug having fuses with larger contact surfaces.

Heretofore, fused plug assemblies have involved the use of fastening devices such as screws or rivets, or the use of adhesive or other bonding techniques to secure the parts of the plug body together. It is desirable that there be ready access to the fuses in the plug for replacement, and that this access be accomplished by way of a door rather than necessitating that the plug body be disassembled.

One fused plug having the above advantages has been disclosed in U.S. Pat. No. 4,684,914 to Wu entitled "Combination Plug". Wu's plug is useful as it has an insert which fits into an outer housing and also has a slidable door on the outer housing through which the fuse block is serviceable. However, the fuses in such patent have very small diameter and thus provide very limited contact surface. This results in poor contact between the fuses and the other parts of the plug.

In order to provide a plug which is convenient and yet provides better performance, it is desirable to have a combination plug with fuses having larger contact surface.

SUMMARY OF THE INVENTION

A primary object of the present invention is to provide a combination fused electrical plug which is easily combinable during assembly without the use of high frequency welding.

A further object of the present invention is to provide a combination plug having an inner housing which is slidably fixed into an outer housing.

Another object of the present invention is to provide a combination plug having an easily replaceable fuse assembly.

A further object of the present invention is to provide a combination plug having a door which can be easily disengaged from the plug body by means of a simple tool, such as a screwdriver, so as to remove or to replace the fuse assembly therein.

Another object of the present invention is to provide a combination plug having fuses with larger contact surfaces.

Yet another object of the present invention is to provide a combination plug having a detachable snap fitted conductor body.

These and other objects and advantages of the present invention will become apparent after a reading of the detailed description provided hereinbelow, with appropriate reference to the attached drawings.

DETAILED DESCRIPTION OF THE PREFERRED EMBODIMENT

Figure 1:
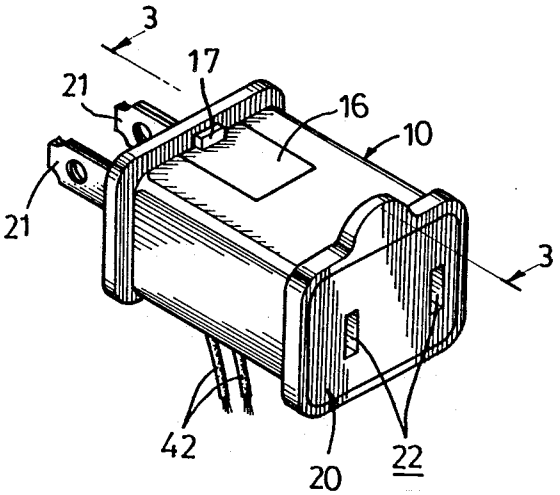
FIG. 1 is a perspective view of a fused electrical plug in accordance with the present invention.
Figure 2:
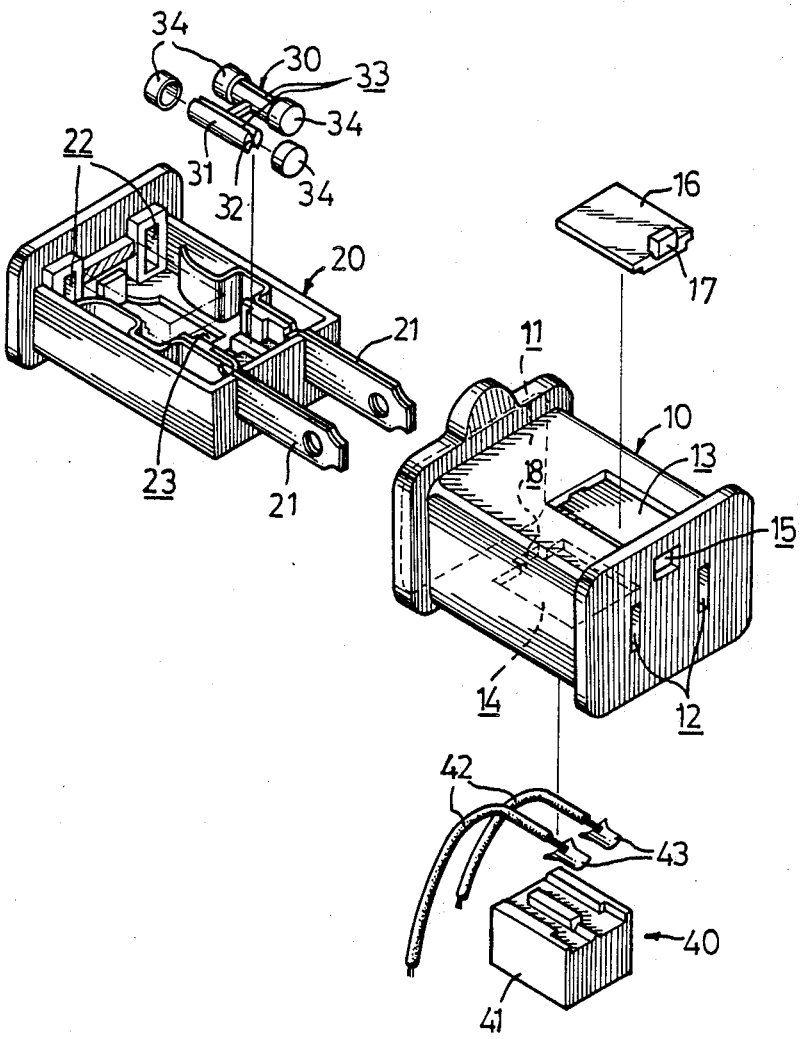
FIG. 2 is an exploded view of the fused electrical plug shown in FIG. 1.

Referring to the drawings and initially to FIGS. 1 and 2, a combination fused electrical plug contructed in accordance with the present invention comprises an outer housing 10, an inner housing 20 slidably insertable into the outer housing 10, a fuse assembly 30 retained within the inner housing 20, and a snap fitted conductor body 40 fitted within the outer housing 10.

The outer housing 10 is substantially a hollow shell having an opening 11 at a rear end thereof for receiving the main body of the inner housing 20, two slots 12 at a front face thereof for the prongs 21 of the inner housing 20 to pass through, a first access opening 13 at an upper face thereof which allows for the interchanging of the fuse assembly 30, a second access opening 14 at a lower face thereof wherein the snap fitted conductor body 40 is fitted, and a hole 15 on a front face thereof proximate to the first access opening 13 and horizontally positioned between the two slots 12. A door 16 is provided to cover the first access opening 13 once the fuse assembly 30 is properly fixed. The door 16 can be easily disengaged or dislodged from the outer housing 10 by pushing the door 16 through the hole 15 from the plug body by means of a simple tool, such as a screwdriver. The door 16 includes a protrusion 17 which is tightly engageable with the hole 15 when in a closed position.

The inner housing 20, as mentioned previously, comprises a pair of prongs 21 at the front part thereof which are passable through the slots 12 of the outer housing 10 upon assembly. The inner housing 20 further includes a pair of openings 22 at the rear end thereof for receiving the prongs of an add-on plug. The inner housing 20 also includes an access opening 23 at a lower face thereof which matches with the second access opening 14 of the outer housing 10 for receiving and retaining the snap fitted conductor body 40.

The fuse assembly 30 is retained in a fuse recess area within the inner housing 20. The fuse assembly 30 comprises an H-shaped plastic fuse holder 31, a pair of fuses 32 held in respective grooves 33 of the plastic fuse holder 31, and four copper covers 34, each cover 34 covering respective terminal of the Hshaped fuse holder 31, thereby connecting both ends of each fuse 32.

The conductor body 40 comprises a conductor tap casing 41, two conducting wires 42, and two conductor taps 43. The conductor tap casing 41 is substantially a box-shaped body. The conductor body 40 can be easily snap fitted into the second access opening 14. When in a closed position, the construction of the conductor body 40 and the window 14 defines a passage hole 18 for the conducting wires 42.

The fuse assembly 30 contacts both the conductor taps 43 of the conductor body 40 and the prong 21 when in an assembled position. It should be noted that the provision of the copper covers 34 is to provide a larger contact surface between the fuses 32 and the conducting taps 43 of the conductor body 40 and also the prongs 21.

The electrical wires of an appliance or some other type of device are connected to the conductor body 40. This kind of conductor body 40 allows for greater interchangeability of electrical parts and makes repair of the fused electrical plug easier. For instance, if one of the two prong 21 breaks, then the whole plug assembly, excluding the conductor body 40, can be safely replaced, instead of splicing another plug to the cord, thereby increasing the chances of an electrical shock to the user due to an improper repair job.

Figure 3:
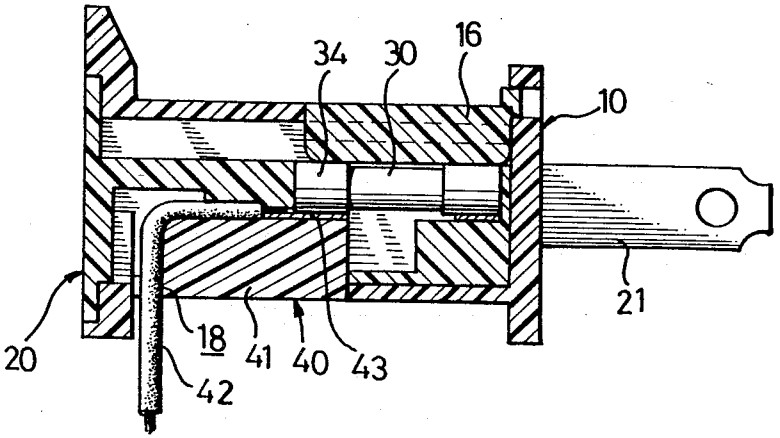
FIG. 3 is a transverse sectional view of the fused electric plug taken along line 3—3 of FIG. 1.

The way that the outer housing 10 and the inner housing 20 fit together and work together can be seen from the transverse cross-sectional view of FIG. 3. The conductor body 40 fits into the outer and inner housing 10 and 20. The conductor taps 43 are connected to electrical wires 42 and are secured in the conductor tap casing 41. It can also be seen that, when in an assembled condition, one end of each fuse assembly 30 contacts a respective conductor tap 43 and the other end contacts a respective prong 21. The door 16 helps to hold the fuse assembly 30 in place.

While the invention has been explained in relation to its preferred embodiments, it is to be understood that various modifications thereof will become apparent to those skilled in the art upon reading this specification. Thus, it will be most appreciated that the invention disclosed herein is intended to cover all such modifications as fall within the scope of the appended claims.

I claim:

1. A combination plug comprising:

an outer housing which is substantially a hollow shell having an opening at a rear face thereof, two slots at a front face thereof, a first access opening at an upper face thereof, a second access opening at a lower face thereof, a hole on the front face thereof proximate to said first access opening and horizontally positioned between the two slots, and a door for covering said first access opening;

an inner housing slidably insertable into the outer housing through said opening, said inner housing comprising a pair of prongs which are passable through the slots of the outer housing, a pair of openings at a rear face for receiving the prongs of an add-on plug, and an access opening at a lower face thereof which matches with said second access opening of the outer housing;

a fuse assembly retained within the inner housig, said fuse assembly comprising an H-shaped plastic fuse holder, a pair of fuses held in respective grooves of the plastic fuse holder, and four copper covers, each said cover covering respective terminal of the H-shaped fuse holder; and a snap fitted conductor body fitted within said outer housing, said conductor body comprising a conductor tap casing, two conducting wires, and two conductor taps;

said fuse assembly contacting both the conductor taps of the conductor body and the prongs when in an assembled position, said copper covers providing a large contact surface between said fuses and said conducting taps of said conductor body and said prongs.

2. A combination plug as claimed in claim 1, wherein said door is easily disengageable from the outer housing by pushing the door through the hole by means of a flat headed screwdriver.

3. A combination plug as claimed in claim 1, wherein said door includes a protrusion which is tightly engageable in said hole when in a closed position.

4. A combination plug as claimed in claim 1, wherein the conductor body and the window define a passage hole for the conducting wires when in a closed position.

* * * * *